US005409059A

United States Patent [19]

McHardy

[11] Patent Number: 5,409,059

[45] Date of Patent: Apr. 25, 1995

[54] LOCK MANDREL FOR DOWNHOLE ASSEMBLIES

[75] Inventor: Colin McHardy, Aberdeen, Scotland

[73] Assignee: Petroline Wireline Services Limited, United Kingdom

[21] Appl. No.: 146,169

[22] PCT Filed: Aug. 19, 1992

[86] PCT No.: PCT/GB92/01524

§ 371 Date: Nov. 9, 1993

§ 102(e) Date: Nov. 9, 1993

[87] PCT Pub. No.: WO93/05266

PCT Pub. Date: Mar. 18, 1993

[30] Foreign Application Priority Data

Aug. 28, 1991 [GB] United Kingdom ..... 9118408

[51] Int. Cl.[6] ..... E21B 23/02

[52] U.S. Cl. ..... 166/208; 166/217

[58] Field of Search ..... 166/208, 214, 217, 212

[56] References Cited

U.S. PATENT DOCUMENTS

| | | | |
|---|---|---|---|
| 2,887,163 | 5/1959 | McGowen, Jr. et al. | 166/217 |
| 3,507,329 | 4/1970 | Stone, Jr. | 166/217 |
| 3,863,715 | 2/1975 | Yonker | 166/217 |
| 4,254,829 | 3/1981 | Watkins . | |
| 4,315,544 | 2/1982 | Monauni et al. | 166/214 |
| 4,406,325 | 9/1983 | Bowyer | 166/214 |
| 4,457,368 | 7/1984 | Kniermen et al. | 166/217 |
| 4,576,236 | 3/1986 | Stout et al. . | |
| 4,583,591 | 4/1986 | Krause, Jr. et al. | 166/217 |
| 4,595,054 | 6/1986 | Schroeder . | |
| 4,715,445 | 12/1987 | Smith, Jr. . | |
| 4,997,038 | 3/1991 | Welch | 166/217 X |

*Primary Examiner*—Ramon S. Britts
*Assistant Examiner*—Frank S. Tsay
*Attorney, Agent, or Firm*—Lalos & Keegan

[57] ABSTRACT

A locking mandrel is provided for use in downhole assembly and comprises a cylindrical body (12) having an annular series of openings (20) in which locking keys (21) are movably positioned, the keys (21) being biased radially inwardly, and an inner mandrel (13, 14) for moving the keys (21) from a withdrawn primed condition to an extended set position. Additionally the body (12) includes a series of movable no-go members (22) below the keys (21) which are extended in the primed condition so as to be engageable with a no-go ring (R2) on a downhole tubing string to axially arrest the body. The outer surface of the inner mandrel (13, 14) is suitably profiled, and the arrangement is such that with the no-go members (22) engaging the no-go ring, the inner mandrel (13, 14) is movable relative to the body (12) preferably after a shear member (15) between the body and the mandrel has ruptured, to shift the keys (21) radially to the set position where the keys (21) engage on a receiving formation (R1) of the tubing string, and after this setting to cause the no-go member (22) to move radially inwardly and free from the no-go ring (R2). Any axial load is then taken substantially fully through the keys (21). The no-go members comprise flexible fingers formed in the cylindrical body so as to be integral with the body.

13 Claims, 2 Drawing Sheets

LOCK MANDREL FOR DOWNHOLE ASSEMBLIES

FIELD OF THE INVENTION

This invention relates to a lock mandrel for downhole assemblies, i.e. lock mandrels with flow control accessories for use in oil and water/gas well operations.

DESCRIPTION OF THE PRIOR ART

Downhole assemblies are known and are used to anchor and seal the assembly in position in the well tubing string.

The assembly is run in and positioned in the well at the pre-determined setting depth by engaging a restriction in the tubing known as the 'no-go'. For this purpose, the assembly has a no-go shoulder. In some constructions the assembly is supported by the no-go shoulder, but in others the engagement of the shoulder in the no-go causes a shear pin to shear and allows lock-out keys or 'dogs' to engage a profile in the tubing and lock the assembly in position. In such constructions the no-go shoulder is deformable to provide for initial positive positioning before the keys lock out at which stage the shoulder then 'disappears'. After use, a new no-go shoulder has to be located on the assembly.

Disadvantages of the deformable no-go shoulder are not only that they have of necessity to be replaced after use, but also a deformed shoulder can become stuck and therefore difficult to remove.

Other constructions have permanent no-go shoulders or movable no-go rings, but disadvantages of these known constructions are that the permanent no-go shoulders can become stuck in incorrect positions while movable no-go rings can cause misruns by premature shear.

U.S. Pat. Nos. 4,595,054 and 4,254,829 disclose lock mandrels but these have the disadvantage of using separate removable dogs for locking the main cylindrical body and this complicates and adds to the expense of the structure.

An object of this invention is to obviate or mitigate the aforesaid disadvantages.

SUMMARY OF THE INVENTION

The above object is met by the present invention by providing a locking mandrel located in a surrounding casing means of a downhole assembly. The casing means includes are a receiving means defining a no-go location, a plurality of radially movable no-go members biased in a radial direction. The inner mandrel means has a profiled external surface for reaction with locking keys disposed on its cylindrical body and the no-go members such that, in an initial primed condition of the mandrel, the inner mandrel means positions the no-go members in an extended condition for engagement with the receiving means while allowing the locking keys to be retained within the outer surface of the body. The cylindrical body is fashioned to provide a plurality of flexible fingers constituting the no-go members which are integral with and permanently attached to said cylindrical body, each of the fingers having one end free and the other end integral with the cylindrical body. The fingers are adapted for controlled movement by the inner mandrel means whereby the free ends of the fingers are moved selectively relative to the outer surface of the cylindrical body between the no-go location and a position free of the receiving means.

Preferably, the inner mandrel is formed of upper and lower parts whereby the lock mandrel can be retrieved by raising the upper part so that the proflethereon allows radially inward withdrawal of the locking keys while the lower part continues to allow the no-go members to remain withdrawn.

An embodiment of the present invention will now be described, by way of example, with reference to the accompanying drawings.

BRIEF DESCRIPTION OF THE DRAWINGS

Referring to FIGS. 1–3 of the drawings, a lock mandrel is connected at its upper end to a flow control accessory not shown to form a downhole assembly.

DESCRIPTION OF THE PREFERRED EMBODIMENTS

Figure 1:
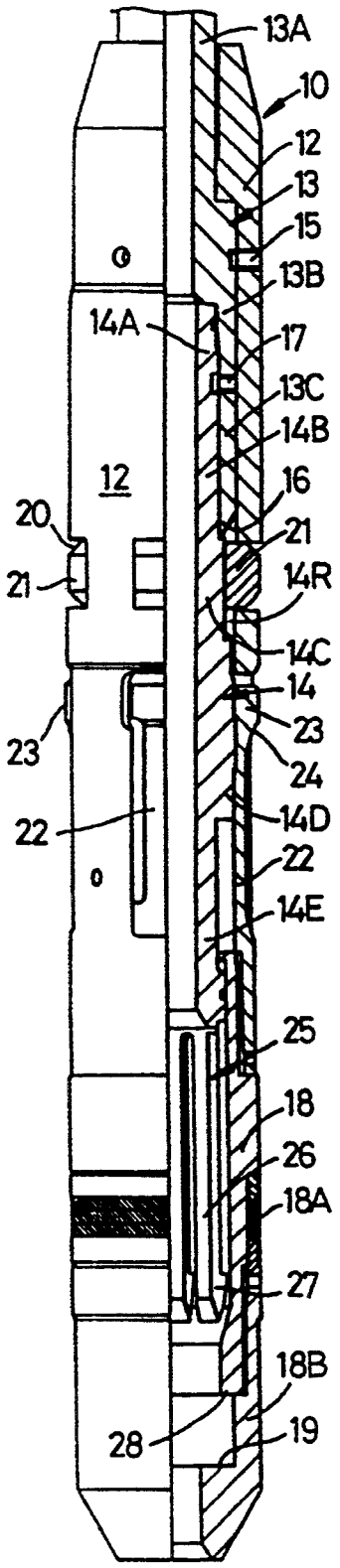
FIG. 1 is a half sectional elevation of a lock mandrel for a downhole assembly according to the invention shown in the primed condition.

The lock mandrel which in use is disposed upright comprises a cylindrical tubular body 12 within which is a two piece inner mandrel having upper and lower parts 13, 14.

The upper part 13 has a neck 13A which extends upwardly out of the body 12, and a shoulder 13B which locates below an internal stop face 11 near the upper. end of body 12.

Below the stop face 11 a shear pin 15 connects the inner mandrel 13/14 to the body 12.

Below the shear pin 15 the upper part 13 of the inner mandrel has a skirt 13C which has at its lower end a profiled face 16 specifically of tapering form. A shear pin 17 passes through the skirt 13C into the upper end of the lower part 14 of the inner mandrel, connecting the two parts together.

The lower part 14 of the inner mandrel has a profiled outer surface achieved by appropriate sizing of the outer diameter along the length of the part 14 thereby forming a short neck portion 14A at the top of part 14, then a portion 14B of slightly larger diameter which forms a step whence the diameter increases to a short third portion 14C which also forms a step, then further increases to a fourth section 14D which forms an undercut and finally the part 14 narrows in diameter to form the lower, fifth portion 14E. A recess 14R is present between the portion 14D and the part 13C, at the portion 14C.

The inner mandrel is slidable within the body 12 but when the lock mandrel is in the primed condition (FIG. 1) for moving downhole, the inner mandrel is held in a raised position in the body by means of the shear pin 15. At the lower end of the body 12 is a downwardly extending packing barrell 18 surrounded by packing 18A.

The packing barrel 18 has a bottom sub 18B connected thereto. The bottom sub 18B has a ledge 19 which the lower end of the lower mandrel part 14 extends towards when it moves downwards as hereinafter described; a coil spring (not shown) may be incorporated around the lower part 14 to dampen the downward movement.

The body 10 has a plurality of windows 20 within which are located locking keys 21 biassed radially inwardly to an inner or withdrawn position in the primed condition in which the keys 21 are within the outside diameter of the body as shown in FIG. 1.

The inner surfaces of the keys 21 engage a profiled outer surface of the inner mandrel 13, 14 and in the primed position (FIG. 1), the recess 14R at the portion 14C of the profiled surface accommodates the withdrawn keys 21.

Below the keys 21 are a plurality of no-go members in the form of upwardly directed fingers 22. They are integral at their lower ends with the body 12 and they are biassed inwardly to lie within the outside diameter of the body, as shown in (FIG. 2), when the recess 14R is moved opposite the fingers 22. The upper end 23 of each finger has an inner surface which, when the lock mandrel is primed abuts the upper profiled surface of portion 14D of the inner mandrel, which portion 14D in the primed condition, forces the finger ends 23 radially outwards beyond the outside diameter of the body 10 as shown in (FIG. 1). The outer surface of each finger 22 has an overhang which together form a no-go shoulder 24 to abut a no-go ring generally shown as $R_2$ on the tubing string.

Figure 2:
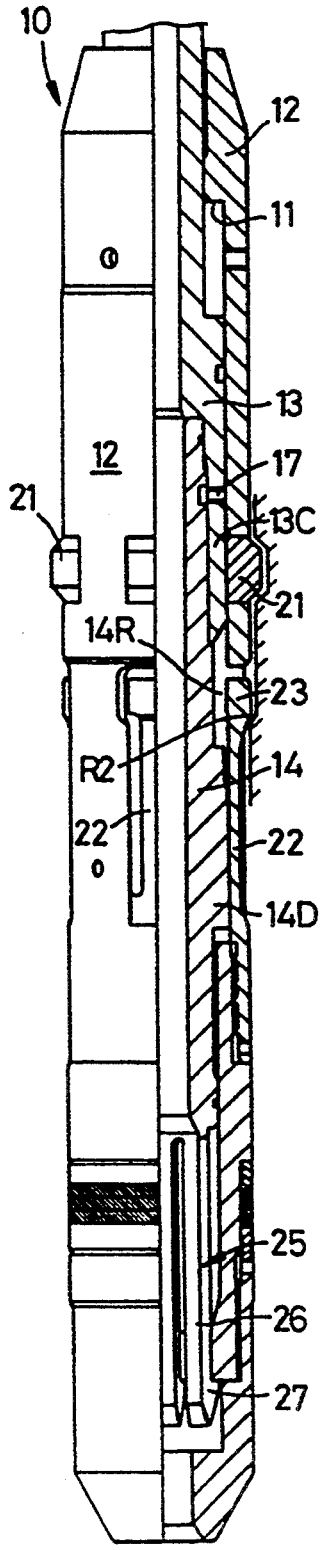
FIG. 2 is a similar view of the lock mandrel in the locked condition.

When the inner mandrel 13, 14 moves downwards, as hereinafter described with the fingers 22 engaging the no-go ring $R_2$, the profiled surface 14C runs down the inner face of the keys 21 and the profiled lower face 16 of skirt 13C pushes the keys 21 outwards and the outer surface of the skirt 13C then retains the keys extended, as illustrated in (FIG. 2).

When the inner mandrel 13, 14 moves down the body 10, as hereinafter described, the profiled portion 14D runs down and off the inner face of the finger ends 23 and the narrower diameter portion 14C of the profiled surface of the lower mandrel part 14 allows the inward biassing or withdrawl of the fingers 22 so that the finger ends 23 locate within the outside diameter of the body 12E within recess 14R. Only when the keys 21 are set in a receiving means (indicated as $R_1$) of the downhole tubing string are the no-go fingers 22 permitted to free from the no-go ring ($R_2$) and move into the recess 14R.

In use, the lock mandrel connected to the chosen accessory, is primed so that the finger ends 23 are extended radially and the keys 21 are withdrawn, (FIG. 1).

When the lock mandrel reaches the setting depth, the no-go shoulders 24 firmly engage the tubing no-go ring ($R_2$) and this enables the shear pin 15 to be sheared. The inner mandrel 13, 14 is then free to move downwards within the body 12 and the profiled surfaces of the upper and lower parts 13, 14 are such as to firstly activate the keys 21 into their radially extended positions and then allow retraction of the finger ends 23. The lock mandrel is then in the locked condition, (FIG.2) being firmly held in place by engagement of the keys 21 against the profiled tubing at $R_1$.

When the inner mandrel 13, 14 moves downwards, a lock down collet 25 comes into use. The collet 25 is fixedly attached to the lower part 14 of the inner mandrel and has downwardly extending fingers 26 which have hooked lower ends 27. These ends 27 engage below a stop surface 28 at the lower end of the packing barrel 18 and thus prevents further upward movement of the inner mandrel at least until the shear pin 17 is sheared to Separate the upper part 13 from the lower part 14 which remains immovable due to the collet fingers 26.

Figure 3:
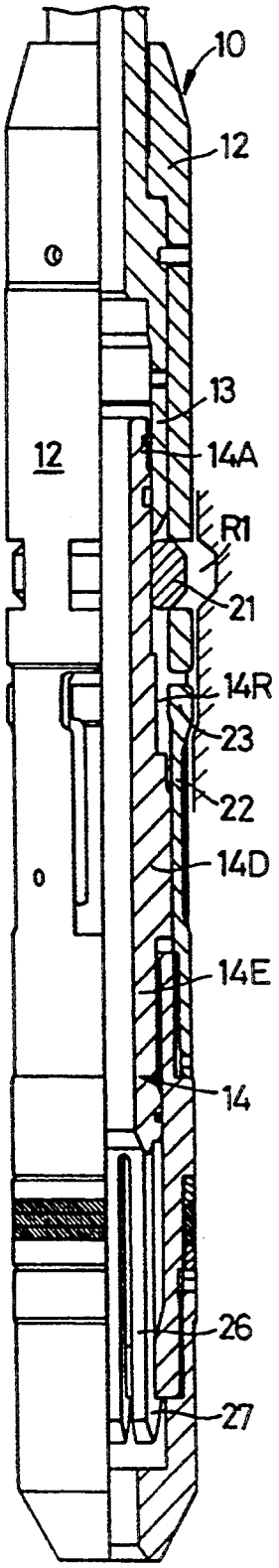
FIG. 3 is a similar view of the lock mandrel in the retrieval condition.

Thus, the two-piece inner mandrel 13, 14 enables easy retrieval of the assembly. In a simple operation an upward pull causes shear pins 17 to shear so that the upper part 13 can be pulled upwards until portion 13B abuts the stop face 11 of the body 12, (FIG. 3). Lifting of part 13 draws the skirt 13C clear of the keys and allows them to retract, freeing the lock mandrel from engagement with the tubing profile.

As the lower part 14 of the inner mandrel is still held in its lowered position, the fingers 22 remain in their withdrawn position, so the lock mandrel can be lifted up the tubing and retrieved.

Advantages of a lock mandrel as hereinbefore described are as follows:

1. There is a positive hard no-go positioning of the device by the extended fingers 22 prior to location of the lock out keys 21.
2. The keys 21 are locked out before the no-go members (fingers 22) are released.
3. There is no deformable no-go device to damage or replace.
4. There is no requirement for high tolerence positioning of the no-go shoulder and key profiles.
5. The pressure on the device from above or below is held by the lock-out keys and never by the no-go shoulder.

The accessory may be a standing valve, blanking plug or other flow control device.

In a second embodiment, now described with reference to FIGS. 4 and 5, like parts are indicated by the numerals used in FIGS. 1 to 3.

In this embodiment the fourth section 14D (FIGS. 1 to 3) of the inner mandrel is of reduced diameter to provide only a narrow ledge 30 at its upper end abutting the internal diameter of the outer body 12 just below the windows 20. Thus the outer surface of portion 14D is generally spaced inwardly of the body 12.

A sleeve 31 locates in the space between the portion 14D of the inner mandrel and the body 12 and it abuts the finger end sections 23.

Figure 4:
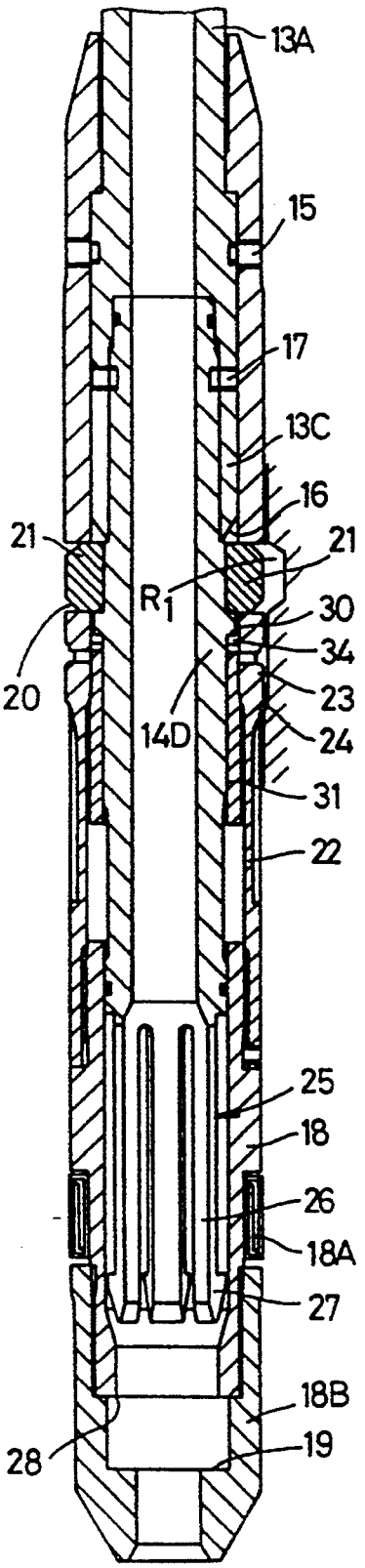
FIGS. 4 and 5 show similar views to FIGS. 1 and 2 for a further embodiment of the present invention.
Figure 5:
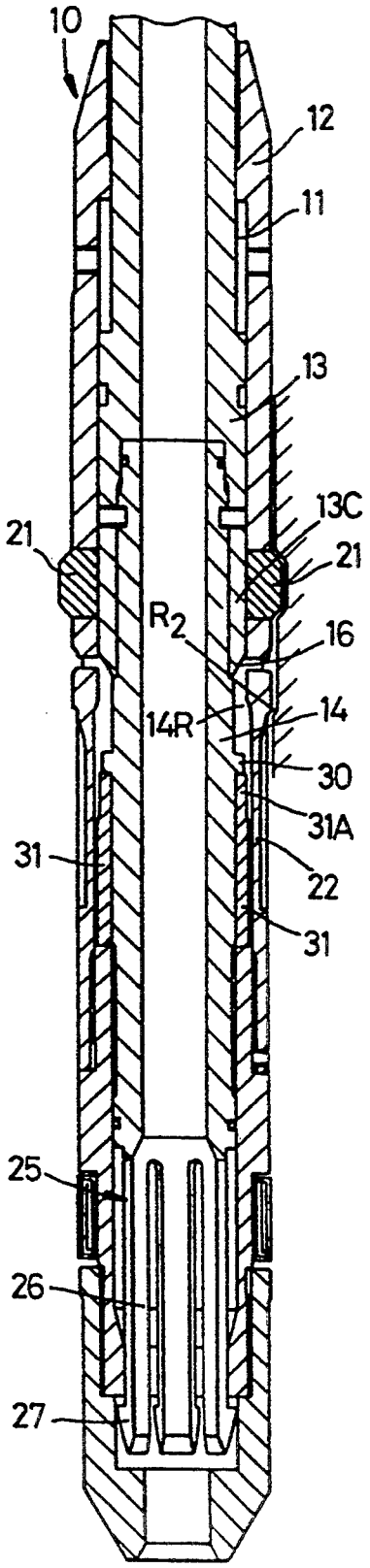

The sleeve has a short neck portion 31A which, in the running mode, FIG. 4 is engaged by the upper end 23 of the fingers thus providing a short gap 34 between the ledge 30 of the inner mandrel and the top edge of the sleeve.

The sleeve is of a low friction material.

When the tool has run downhole it lands on the desired no-go shoulder and downward pressure shears shear pin 15, the inner mandrel will move downwards initially through the sleeve before the ledge 30 engages the sleeve, after which both inner mandrel and sleeve move downwards together.

The purpose of the sleeve is to prevent friction-bind of the fingers against the inner mandrel. This can happen when the tool lands on the no-go shoulder and as a consequence the pressure required to shear the shear pins 15 can become very erratic.

The sleeve 31 removes the possibility of friction-bind and consequently a more accurate control of the pressure required to shear the shear pins 15.

In the described embodiments the no-go members are fingers 22 which, due to their length are flexible enough to allow movement of the finger ends 23.

Whereas in the above described examples movement from the primed to the set condition is achieved by a downward movement of the inner mandrel 13, 14, it would be possible as an alternative to have an arrangement where movement from the primed to the set condition is achieved by an upwards movement of the inner mandrel.

I claim:

1. Locking mandrel apparatus for use in downhole assemblies, said locking mandrel being located in a surrounding casing means of a downhole assembly and comprising a cylindrical body which in use is disposed upright, a plurality of radial openings in said body, locking keys located in said openings, biasing means to move said locking keys radially to locate in an aperture means of said surrounding casing means so as to place the mandrel in a locked or set condition, inner mandrel means adapted for axial movement relative to said body, said casing means additionally including receiving means defining a no-go location, a plurality of radially movable no-go members, said no-go members being biased in a radial direction, said inner mandrel means having a profiled external surface for reaction with said locking keys and the no-go members such that, in an initial primed condition of the mandrel, the inner mandrel means positions the no-go members in an extended condition radially outward beyond the outer surface of said body for engagement with said receiving means while allowing the locking keys to be retained within said outer surface of the body, movement of the inner mandrel means in a first axial direction from said primed condition when the no-go members are at the no-go location causing the locking keys to be moved radially by said biasing means, beyond the outer surface of the body for reception in said aperture means and then causing the no-go members to retract within the outer surface of the cylindrical body free from said receiving means, wherein the cylindrical body is fashioned to provide a plurality of flexible fingers which are integral with and permanently attached to said cylindrical body, said fingers constituting said no-go members, each of said fingers having one end free and the other end integral with the cylindrical body, said fingers being adapted for controlled movement by said inner mandrel means whereby said free ends of the fingers are moved selectively relative to the outer surface of the cylindrical body between said no-go location and a position free of the receiving means, said free ends of the fingers being adapted for engagement with the receiving means in the no-go location.

2. A locking mandrel as claimed in claim 1, wherein in said primed condition, the inner mandrel means is connected to the body by first shear means, which is caused to rupture prior to said axial movement of the inner mandrel means, from the primed condition.

3. A locking mandrel as claimed in claim 1, wherein in the set condition axial loading is taken substantially solely through the locking keys.

4. A locking mandrel as claimed in claim 1, wherein the inner mandrel means additionally includes a sleeve part.

5. A locking mandrel as claimed in claim 4, wherein said sleeve part is movable by the inner mandrel means.

6. A locking mandrel as claimed in claim 1, wherein a lock means is provided which in the set condition prevents movement of the inner mandrel means in an axial direction opposite to said first direction.

7. A locking mandrel as claimed in claim 6, wherein the cylindrical body includes, at its lower end, a component having a ledge engageable by the inner mandrel means in said set condition to prevent upward movement of the inner mandrel means.

8. A locking mandrel as claimed in claim 7, wherein the lock means comprises flexible fingers defining collets.

9. A locking mandrel as claimed in claim 1, wherein the inner mandrel means includes damping means associated therewith to dampen its descent.

10. A locking mandrel as claimed in claim 1, wherein the profiling of the inner mandrel means provides a recess for the locking keys in said primed condition, said recess serving to receive the no-go members in the set condition, the arrangement being such that the locking keys are placed in a set condition in said aperture means prior to said no-go members moving into said recess free of the receiving means.

11. A locking mandrel for use in downhole assemblies, said lock mandrel being located in surrounding casing means of a downhole assembly and comprising a cylindrical body which in use is disposed upright, a plurality of radial openings in said body, locking keys located in said openings, biasing means to move said locking keys radially to locate in an aperture means of said surrounding casing means so as to place the mandrel in a locked or set condition, inner mandrel means adapted for axial movement relative to said body, said casing means additionally including receiving means defining a no-go location, a plurality of radially movable no-go members, said no-go members being biased in a radial direction, said inner mandrel means having a profiled external surface for reaction with said locking keys and the no-go members such that, in an initial primed condition of the apparatus, the inner mandrel means positions the no-go members in an extended condition radially outward beyond the outer surface of said body for engagement with said receiving means while allowing the locking keys to be retained within said outer surface of the body, movement of the inner mandrel means in a first axial direction from said primed condition when the no-go members are at the no-go location causing the locking keys to be moved radially by said biasing means, beyond the outer surface of the body for reception in said aperture means and then causing the no-go members to retract within the outer surface of the cylindrical body free from said receiving means, wherein the cylindrical body is fashioned to provide a plurality of flexible fingers which are integral with and permanently attached to said cylindrical body, said fingers constituting said no-go members, each of said fingers having one end free and the other end integral with the cylindrical body, said fingers being adapted for controlled movement by said inner mandrel means whereby said free ends of the fingers are moved selectively relative to the outer surface of the cylindrical body between said no-go location and a position free of said receiving means, said free ends of the fingers being adapted for engagement with the receiving means in the no-go location, the inner mandrel means comprising upper and lower overlying parts which are relatively movable apart, said upper part being profiled to maintain the locking keys in the aperture means in said locked condition while said lower part is profiled to permit the no-go members to move into engagement with the receiving means and also to free from said receiving means, whereby the locking mandrel can be retrieved by raising the upper part to permit radial inward withdrawal of the locking keys while the lower part remains in a position permitting the no-go members to be free of said receiving means.

12. A locking mandrel as claimed in claim 11, wherein said upper and lower parts of the inner mandrel means are connected by second shear means.

13. A locking mandrel as claimed in claim 11, wherein said upper and lower parts are arranged telescopically, a recess means being provided between said upper and lower parts providing a first recess to receive the locking keys in the primed condition and also subsequently to receive the no-go members in said locked condition, relative movement apart of said upper and lower parts increasing the length of said recess means whereby said recess means becomes capable of receiving both the locking keys and the no-go members simultaneously to permit retrieval of the locking mandrel.

* * * * *